US006616140B2

(12) United States Patent
Siegenthaler

(10) Patent No.: US 6,616,140 B2
(45) Date of Patent: Sep. 9, 2003

(54) STORAGE APPARATUS HAVING A CARD-ACCOMMODATING, VERTICALLY UPRIGHT STACK-STORAGE CASSETTE

(75) Inventor: Fritz Siegenthaler, Gümligen (CH)

(73) Assignee: Ascom Autelca AG, Gumligen (CH)

( * ) Notice: Subject to any disclaimer, the term of this patent is extended or adjusted under 35 U.S.C. 154(b) by 0 days.

(21) Appl. No.: 09/971,926

(22) Filed: Oct. 9, 2001

(65) Prior Publication Data

US 2002/0056691 A1 May 16, 2002

(30) Foreign Application Priority Data

Oct. 9, 2000 (EP) ..... 00810895

(51) Int. Cl.[7] ..... B65H 31/04

(52) U.S. Cl. ..... 271/213; 271/214; 271/215; 271/217

(58) Field of Search ..... 271/213, 214, 271/215, 217

(56) References Cited

U.S. PATENT DOCUMENTS 1,303,041 A * 5/1919 Droitcour ..... 271/217
4,413,541 A * 11/1983 Biggar, III ..... 83/346
4,509,739 A * 4/1985 Kurokawa ..... 271/176
4,511,301 A * 4/1985 Kawano et al. ..... 414/790.2
4,526,264 A * 7/1985 MacNamara et al. ..... 194/217
4,585,225 A * 4/1986 Miura ..... 271/211
5,314,177 A * 5/1994 Anma ..... 271/3.04

FOREIGN PATENT DOCUMENTS

EP 0 198 756 A 10/1986
GB 2 183 221 A 6/1987
GB 2 183 222 A * 6/1987 ..... B65H/1/04
JP 58109358 A * 6/1983 ..... B65H/31/12
JP 02062326 A * 3/1990 ..... B65H/1/14

* cited by examiner

*Primary Examiner*—Donald D P Walsh
*Assistant Examiner*—M. Kohner
(74) *Attorney, Agent, or Firm*—Birch, Stewart, Kolasch & Birch, LLP

(57) ABSTRACT

A storage apparatus has a card-accommodating, vertically upright stack-storage cassette (1) and a card-input, -reading and control unit (3) arranged adjacent to the top cassette-border region (4). The stack-storage cassette (1) has a vertically running storage opening (5) arranged in a cassette side. The storage apparatus also has a lift unit (7) which can be displaced vertically in said opening (5) and has a lift housing (19*a*, 19*b*). The lift unit (7), for its part, has a depositing plate (9) for the cards, which comes to rest in the store interior (10). The lift unit can be removed in the lowermost region of the cassette (1), to be inserted into the cassette (1) at the top and, acting on the opening borders, to be displaced vertically, i.e. lowered, in each case preferably by the distance of a height over which a group of cards is deposited, in order for the cards to be deposited satisfactorily.

16 Claims, 5 Drawing Sheets

Fig. 3
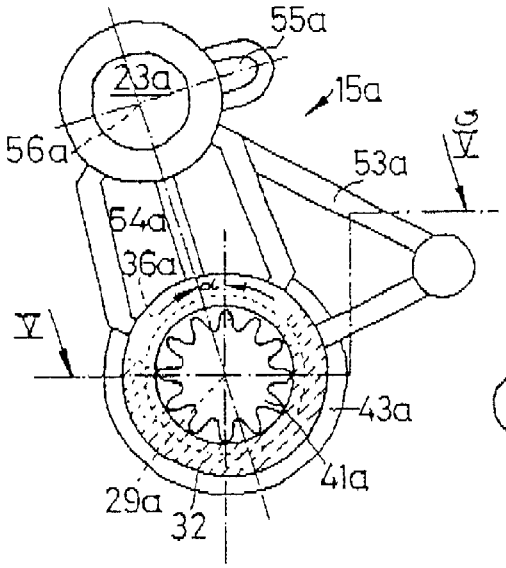
Fig. 4
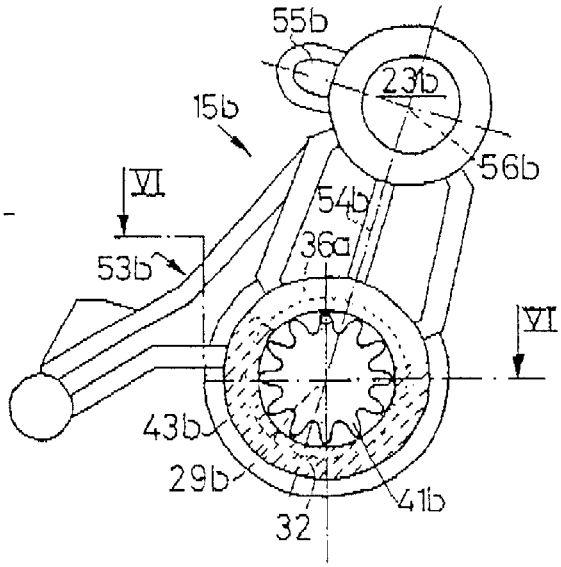
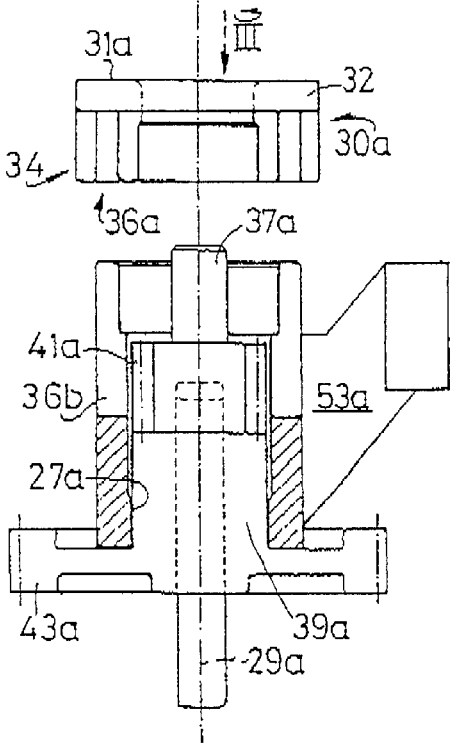
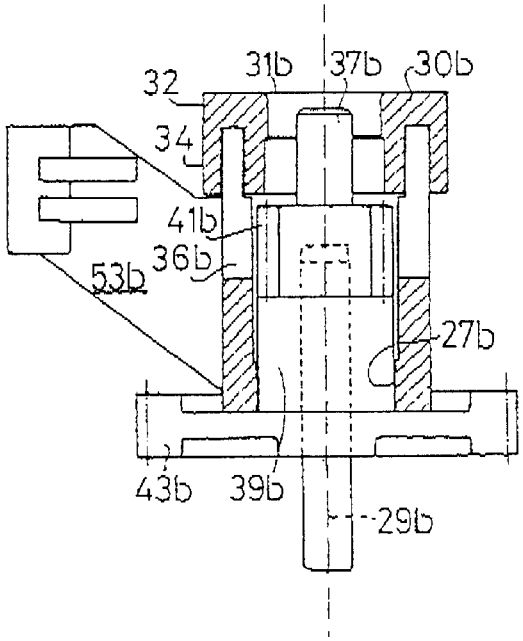
Fig. 5
Fig. 6

STORAGE APPARATUS HAVING A CARD-ACCOMMODATING, VERTICALLY UPRIGHT STACK-STORAGE CASSETTE

This nonprovisional application claims priority under 35 U.S.C. §119(a) on Patent Application No. 00 810 895.3 filed in EP on Oct. 9, 2000, which is herein incorporated by reference.

TECHNICAL FIELD

The invention relates to a storage apparatus for cards, inter alia, with a vertically upright stack-storage cassette according to Patent claim 1.

Card-accommodating stack-storage cassettes are used wherever a multiplicity of usually equally dimensioned cards are to be deposited. Cards are understood here as being sheet-like articles which preferably contain information. This contained information is usually provided on the cards in a machine-readable manner. The cards are stacked, for the sake of order, in stack-storage cassettes, and it is also possible for said cards to be reused by them being provided with new information or being refreshed.

The cards may be, for example, tickets preferably with a price printed on them. They may also be telephone cards which contain a stored sum of money for making telephone calls. The cards may also be ones which have a sum of money which is stored in them and, for various services obtained, can have amounts debited gradually from it. If a residual sum remains on said card, it is then possible, in a machine, for this sum to be transferred to a new card, usually with a sum of money being paid in addition, or to be paid out. The card information may then be overwritten in the machine; it is often the case, however, that a new card is dispensed. The "old" card is then deposited in a stack-storage cassette, which is retained such that it can be removed from the machine.

DESCRIPTION OF THE INVENTION

OBJECT OF THE INVENTION

The object of the invention is to provide a compact storage apparatus with a large card-accommodating volume.

SOLUTION OF THE OBJECT

The object is achieved by the features of the Patent claim 1.

In order to produce a large card-accommodating volume in a stack-storage cassette, it is not sufficient for this volume to be made as large and/or as high as possible and for the cards simply to be introduced from above. This is because the cards would become wedged, as a result of which it is no longer possible for the cards to be deposited in an ordered manner and the volume of cards which can be stored in the stack-storage cassette would thus also decrease rapidly. According to the invention, a lift unit with a depositing plate for the cards which are to be deposited is thus assigned to the stack-storage cassette. The lift plate can always be lowered, by way of the lift unit, to such an extent that cards, which are usually introduced at high speed ("fired in"), are satisfactorily deposited one above the other. The invention, then, additionally ensures a cost-effective configuration of the storage apparatus and in this case, in particular, a cost-effective configuration of the storage cassette, a large number of which, after all, are required. In addition, the storage apparatus according to the invention does not have any elements which would project beyond the cassette dimensions during the storage operation. Not even the flanged-on electric motor projects downward beyond the foot of the cassette in the lowermost position of the lift unit, with the cassette completely filled.

It has been taken as the departure point to configure the stack-storage cassette in as straightforward, and thus cost-effective, a manner as possible. The lift unit, in contrast, is only required for the storage operation and not for being stowed away thereafter. The lift unit is thus designed such that it can be inserted into the stack-storage cassette and removed therefrom. The stored cards may then be stowed away in an inexpensive stack-storage cassette without a lift unit.

In relation to an optimum cost-effective configuration, the stack-storage cassette is designed such that it has a vertically running opening for the lift unit on a longitudinal side. The lift unit can be inserted into the stack-storage cassette at the top and removed again at the bottom without the card contents being affected. During the storage operation, then, the depositing plate, by way of the lift unit, is lowered non-continuously, in a stepwise manner, in relation to cards which have been introduced. The depositing plate, in its initial position, has already been lowered by the distance of part of the storage height. It is only when this part of the storage height has been filled with a group of cards that the depositing plate is lowered by a further depositing step until the entire stack-storage cassette has been completely filled and is replaced by an empty stack-storage cassette, into the opening of which the lift unit which has been removed from the filled cassette is then inserted at the top.

It is, of course, also possible for the lift unit to be inserted at the bottom and to be displaced upward from there. It is also possible for the lift unit to be "engaged on", and "disengaged from", the top cassette border. With the climbing wheels pivoted in via a slide, the lift unit can freely be displaced vertically.

At each opening border, the stack-storage cassette preferably has a rack which runs longitudinally along it and has teeth preferably directed toward the opening. Matching the rack, the lift unit, on both sides, has in each case one climbing wheel, which is preferably designed as a gearwheel and meshes with the corresponding rack. Using the gearwheel and rack results in the lift unit having satisfactory climbing behavior. Instead of this form fit, however, it is also possible to use a friction fit. In this case, the gearwheel would then be replaced, for example, by a rubber-tired wheel, which would run in a rail on the opening border.

Each climbing wheel (friction wheel or gearwheel) is retained pivotably in a respective first and second retaining unit such that it can be pressed, with spring loading, against the racks, and the two climbing wheels are retained such that they can be displaced toward one another in order to remove the lift unit.

The retaining units will preferably be designed as levers. One lever end has a horizontally running first bearing bushing, which accommodates the rotary axle of the climbing wheel. The other lever end is retained pivotably by a pivot articulation. The climbing wheels can preferably be driven by in each case one set of gearwheels. Each first gearwheel of each set of gearwheels meshes with in each case one of the climbing wheels. The second gearwheels of each set of gearwheels mesh with a worm wheel, which can be driven in particular by an electric motor. As a result, on the one hand, it is possible for the climbing wheels to run in the same direction and, on the other hand, self-locking is achieved when the lift unit is at a standstill.

The pivot articulation at the other lever end of the retaining unit has, in particular, a second bearing bushing, which slides on a coaxial thickening arranged between the first and second gearwheels of the set of gearwheels. This achieves a stable mounting for the pivotable retaining unit and thus also a stable mounting for the climbing wheels, which ultimately have to absorb the entire weight of the cards which are stored i.e. located on the depositing plate. The climbing-wheel-retaining bearing of the pivotable retaining unit is thus not subjected to any disruptive forces which could cause tilting in a direction perpendicular to the plane of the cassette opening. The stabilization is further enhanced by in each case one journal, which is arranged on the inside of the lift housing and has a central bore, and a third bearing bushing at the other lever end, said bearing bushing adjoining the second bearing bushing, the third bearing bushing and the journal being designed such that the retaining unit can be pivoted on the journal by way of the third bearing bushing.

The capacity for stable ("wobble-free") pivoting of the lever-like retaining units can be achieved particularly straightforwardly in that each second bearing bushing and the third bearing bushing have a cutout through which the climbing wheel engages with meshing action in the first gearwheel.

The satisfactory functioning of the lift unit is achieved, in particular, by the provision of a first lever-like extension on the first retaining unit and a second lever-like extension on the second retaining unit, a tension spring between the first bearing bushings of the first and second retaining units and a slide which can be actuated manually counter to the force of a compression spring. The two extensions are arranged such that they are directed away from a connecting axis between in each case the first bearing bushing and the relevant pivot-articulation axis and rest one upon the other as a result of the force of the tension spring. For pivoting purposes, the slide has an elevation which, in a state in which the slide has not been pressed into the lift housing, holds up the second extension, and thus also the first extension, and, in the pressed-in state, by way of the elevation being pushed away, allows the two extensions to be moved downward, as a result of which the retaining unit moves the two climbing wheels toward one another. If the two climbing wheels are moved toward one another, the lift unit can be removed from the opening in particular through a slot corresponding to the depositing-plate thickness, at the bottom opening border. The lift unit can then be inserted into the next, preferably empty stack-storage cassette.

Filling-level monitoring will preferably be carried out in the top cassette region. Whenever this region has been filled with cards, the lift unit is lowered, by way of its depositing plate, by the distance of part of the depositing path. The lift unit is thus lowered in a stepwise manner until the stack-storage cassette has been completely filled.

BRIEF DESCRIPTION OF THE DRAWINGS

Examples of the storage apparatus according to the invention are explained in more detail hereinbelow with reference to the following drawings. Further advantages of the invention can be gathered from the text of the description. In the drawings:

FIG. 3 shows a lateral plan view, analogous to the view in FIG. 1, of a retaining unit used in the lift unit for a climbing wheel of the latter which is on the left-hand side in FIG. 1, FIG. 4 shows a plan view of a retaining unit for the climbing wheel which is illustrated on the right-hand side in FIG. 1, FIG. 5 shows a section, which has been pivoted through an angle $\alpha$ and is taken along the line V—V in FIG. 3, through the retaining unit which is illustrated in FIG. 3 and is on the left-hand side in FIG. 1, the retaining unit nevertheless being illustrated here in a position in which it has been turned over in relation to FIG. 3, in order for it to be possible to better demonstrate the assembly operations for insertion into the housing part 19*a* of the lift unit 7; in this case, the plug-on part 30*a* is depicted in the not yet plugged-on state, FIG. 6 shows a sectional illustration, which is analogous to the section from FIG. 5 and is taken along line VI—VI in FIG. 4, of the retaining unit which is on the right-hand side in FIG. 1, it being the case here that the retaining unit has not been pivoted through the angle $\alpha$ and the relevant plug-on part has been plugged on, FIG. 7 shows a plan view of a housing part of the lift unit shown in FIG. 1, all the "internals" having been removed.

METHODS OF IMPLEMENTING THE INVENTION

Figure 1:
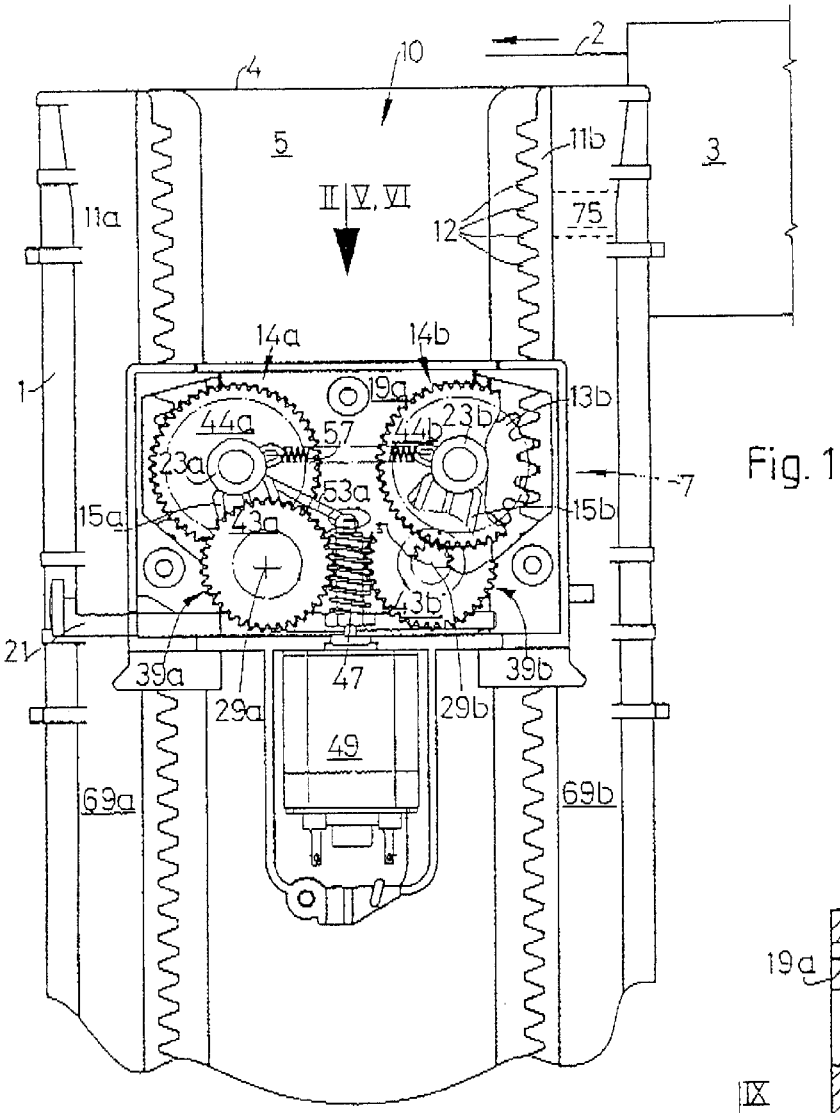
FIG. 1 shows a lateral plan view of the top region of the storage apparatus according to the invention with the lift unit in this precise location, one housing half of said lift unit having been removed in order to provide a view to the interior of the lift unit.
Figure 8:
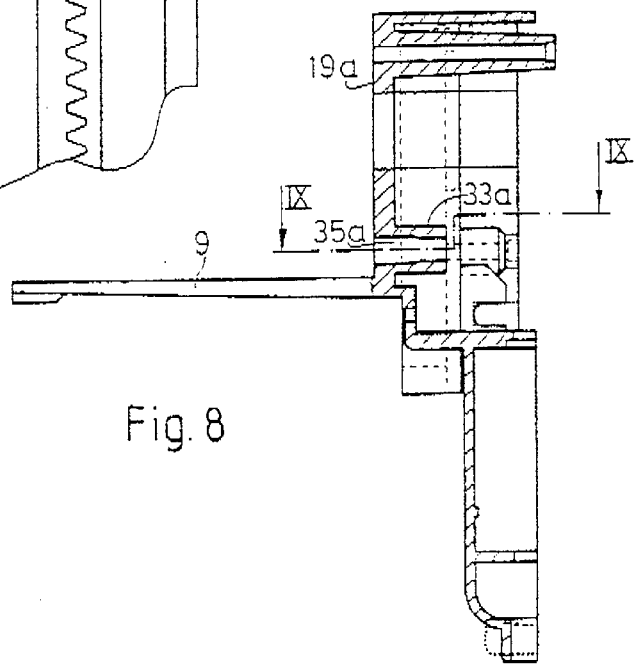
FIG. 8 shows a section through the housing part shown in FIG. 7, the section being taken along line VIII—VIII from FIG. 7.
Figure 2:
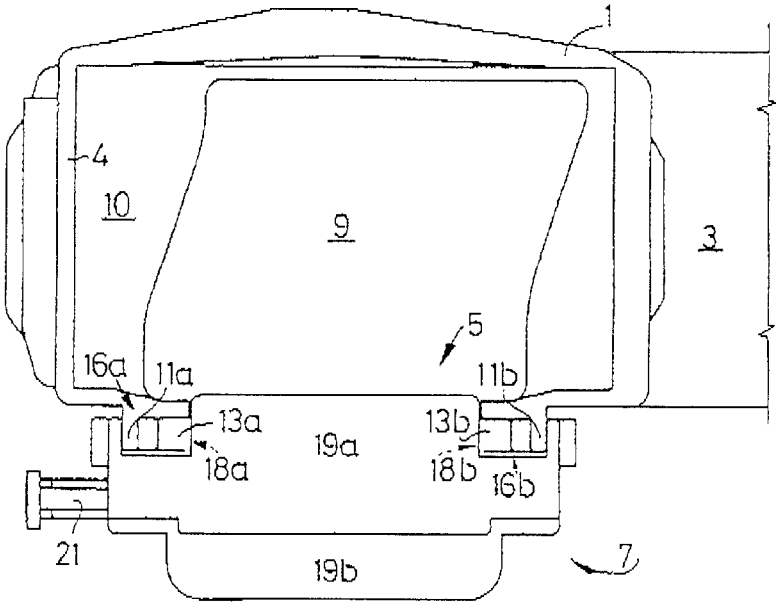
FIG. 2 shows a plan view of the storage apparatus illustrated in FIG. 1.
Figure 7:
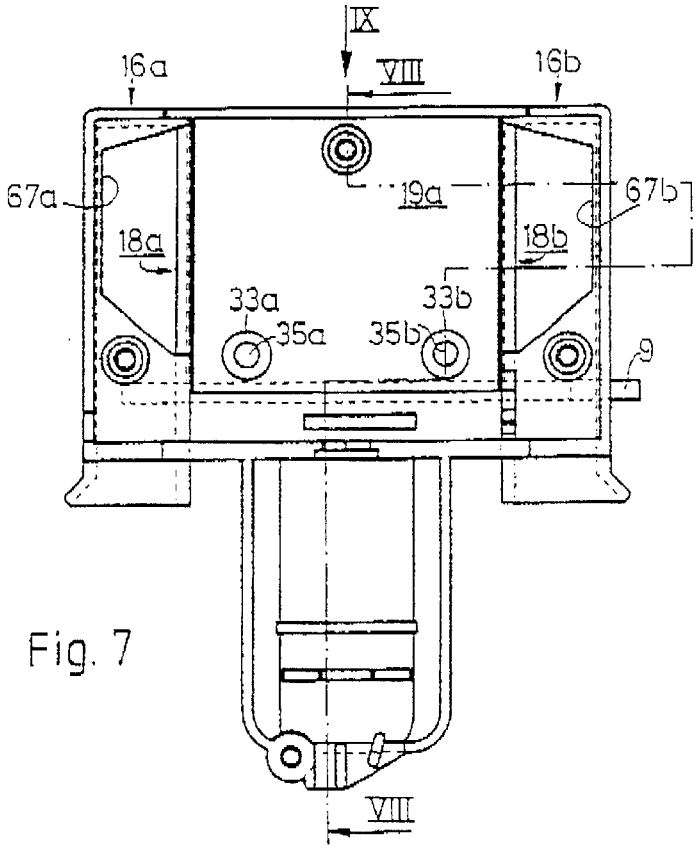
Figure 9:
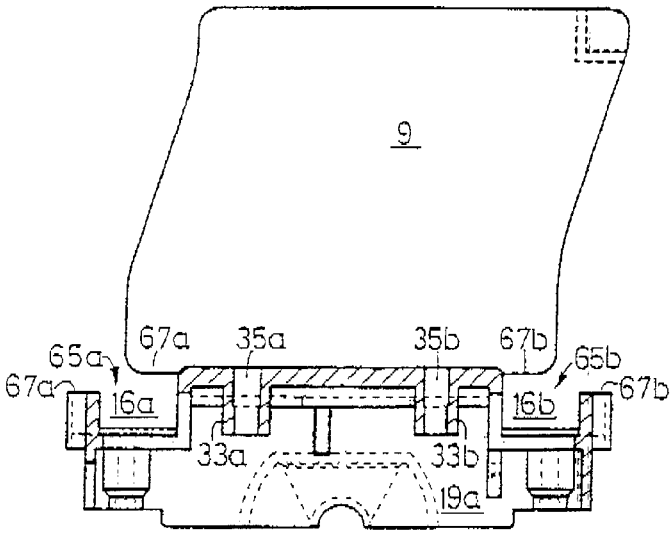
FIG. 9 shows a section through the housing part shown in FIG. 7, the section being taken along line IX—IX in FIG. 8.

The storage apparatus illustrated in FIGS. 1 and 2 has a vertically upright stack-storage cassette 1 for accommodating cards 2 which are to be deposited. The cards which are to be deposited have information stored on them, e.g. sums of money which can have amounts debited from them, and passes giving travel authorization, entrance authorization, etc. It may also be the case that only a single authorization is stored on each card. Once the authorizations have been read out (debited) and the card is no longer valid or is only partially valid or only has a residul authorization or sum of money remaining, the card is withdrawn from circulation and the residual authorization or sum of money may possibly be refunded. The information stored on the relevant card is determined by a card-input, -reading and control unit 3, which is merely indicated in FIGS. 1 and 2. The card is then conveyed into the stack-storage cassette 1, via the top border 4 of the same, from the unit 3. On its front broad side, the stack-storage cassette 1 has a longitudinally running storage opening 5 located symmetrically through the longitudinal center of the broad side.

A lift unit 7 engages through said opening 5 by way of its depositing plate 9, the cards being deposited on said depositing plate in the stack-storage cassette 1. The lift unit 7 can be displaced vertically in said opening. The depositing plate 9 is designed such that the cards are located one above the other on it without dropping downward. The outer contour of the depositing plate 9 is adapted to the cross section of the interior 10 of the stack-storage cassette 1. The lift unit 7, as is described in more detail hereinbelow, can be inserted into the opening 5 via the top border 4 and removed in the base region of the cassette interior.

In each case one longitudinally running rack 11*a* and 11*b* is arranged at the opening borders, the teeth 12 of said rack being directed toward the center of the opening. Matching the toothing of the racks 11*a* and 11*b*, the lift unit 7 has two gearwheels which are designed as climbing wheels 13*a* and 13*b* and belong to a respective climbing-wheel unit 14*a*, 14*b*, in each case one gearwheel 13*a*, 13*b* meshing with the teeth of a respective rack 11*a*, 11*b* which runs along a respective longitudinal groove 16*a*, 16*b* in the lift unit 7. For this purpose, the climbing wheels 13*a* and 13*b* engage through in each case one respective side opening 18*a*, 18*b* in the lift unit/(housing part 19*a*). A gearwheel 44*a*, 44*b* is firmly assigned to each respective climbing wheel 13*a*, 13*b*. The toothed-rim diameter of each gearwheel 44*a*, 44*b* is slightly greater than that of the respective climbing wheels 13*a* and 13*b*. The climbing wheels 13*a* and 13*b* and the gearwheels 44*a* and 44*b* are located centrally in relation to one another, the respective climbing wheel 13*a*, 13*b* always being located on the outside (adjacent to the inner wall of the housing part 19*b*).

Each climbing wheel 13*a*, 13*b* is pressed pivotably in the lift unit 7, by way of a respective first and second retaining unit 15*a*, 15*b*, against the racks 11*a* and 11*b*, loaded by the force of a compression spring 17. For removal from the cassette opening 5 in the cassette-base region, the two climbing wheels 13*a* and 13*b* can be moved toward one another by virtue of a slide 21 being pressed in. The function of the compression spring 17 is described hereinbelow.

The lift unit 7 has a two-part housing. One housing part 19*a* is connected integrally to the depositing plate 9. The two housing parts 19*a* and 19*b* are produced by plastic injection molding, albeit from different plastics. The housing half 19*a* with the "internals" arranged in it is illustrated in FIG. 1. The two climbing wheels 13*a* and 13*b* are arranged in the top region of the housing. The retaining units 15*a* and 15*b* are designed as levers. A respective first horizontally running bearing bushing 23*a*, 23*b* is formed at one lever end, at the top in FIGS. 3 and 4, respectively. Said bearing bushing 23*a*, 23*b* accommodates the respective rotary axle 25*a*, 25*b* of the respective climbing wheel 13*a*, 13*b*. For reasons of stability, the length of the bearing bushings is selected to be as long as possible.

A second bearing bushing 27*a*, 27*b* is arranged at the respectively other lever end. The center line 29*a*, 29*b* of these respective bearing bushings 27*a* and 27*b* is the pivot axis about which the respective retaining unit 15*a*, 15*b* and with the latter also the climbing wheels 13*a* and 13*b*, can be pivoted. Each retaining unit 15*a*, 15*b* is assigned a respective plug-on part 30*a*, 30*b*.

FIG. 6 illustrates the plug-on part 30*b* plugged, and glued on the retaining unit 15*b*. FIG. 5 illustrates an exploded drawing of the plug-on part 30*a* in relation to the associated retaining unit 15*a*.

Each plug-on part 30*a* and 30*b* has a ring 32 on the respective end side 31*a*, 31*b* for support about a respective journal 33*a*, 33*b*, which projects from the housing part 19*a* into the interior of the same. In relation to the position in FIG. 3, the plug-on part 30*a* has been rotated into the vertical through the angle α depicted in FIG. 3. In a circular-cylindrical part 34 adjoining the ring 32, the two plug-on parts 30*a* and 30*b* have a sectorial cutout 36*a* with a center angle of approximately 140°. The cutout 36*a* is designed such that, with the plug-on part 30*a*, 30*b*, and the respective retaining unit 15*a*, 15*b* assembled together, it merges in an aligned manner into a corresponding cutout 36*b* in the respective bearing bushing 27*a*, 27*b*.

During assembly, then, first of all the respective climbing wheel 13*a*, 13*b* is plugged, by way of its axle, into the respective bearing bushing 23*a*, 23*b* on the rear side, in the case of the position shown in FIGS. 3 and 4, and is secured against slipping out by a clamping ring acting on the axial end. The climbing wheel 13*a*, 13*b* and the respective gearwheel 44*a*, 44*b* here are located in the relevant cutout 36*a*, 36*b*, respectively. The relevant plug-on part 30*a*, 30*b* is then plugged on and glued such that the borders of the respective cutout 36*a* and 36*b* are aligned with one another. Each climbing-wheel unit 14*a*, 14*b* is then connected to the relevant retaining unit 15*a*, 15*b*, respectively, such that it cannot be removed therefrom.

In the next assembly step, the two retaining units 15*a* and 15*b*, with respective climbing-wheel unit 14*a*, 14*b* inserted therein, are connected to one another via a tension spring 57. For this purpose, each retaining unit 15*a*, 15*b* has a respective eyelet 55*a*, 55*b* arranged on the outer lateral surface of the relevant bearing 23*a*, 23*b*, respectively. In each case one spring end is suspended in said two eyelets 55*a* and 55*b*. In the state in which they are coupled by spring 57, the retaining units 15*a* and 15*b* are then plugged onto a respective journal 33*a*, 33*b*.

Each journal 33*a*, 33*b* has a central bore, in this case a respective through-passage bore 35*a*, 35*b* (it would also be possible to use a bland bore), into which, in the next assembly step, an axle 37*a*, 37*b* of a respective set of gearwheels 39*a*, 39*b* is plugged. Each set of gearwheels 39*a*, 39*b* has a respective first gearwheel 41*a*, 41*b* and a respective second gearwheel 43*a*, 43*b*. The respectively first gearwheel 41*a*, 41*b* meshes with the respective gearwheel 44*a*, 44*b*, which is firmly assigned to the respective climbing wheel 13*a*, 13*b*, through the cutouts 36*a* and 36*b*. Each cutout is selected to be large enough for the relevant climbing wheel 13*a*, 13*b* to engage through it and also for the gearwheel 44*a*, 44*b* to remain in engagement with the respectively first gearwheel 41*a*, 41*b* over the entire pivoting region of the respective retaining unit 15*a*, 15*b*.

As can clearly be seen in FIG. 1, each second gearwheel 43*a*, 43*b* of the respective set of gearwheels 39*a*, 39*b* meshes with a worm wheel 47 which is seated on a drive shaft of an electric motor 49. The two climbing wheels 13*a* and 13*b* are connected, via the worm wheel 47 and the two sets of gearwheels 39*a* and 39*b*, such that they run in the same direction. In addition, this also achieves self-locking, even if the electric motor 49 has no current running through it. The level of self-locking is high enough to achieve a sufficient retaining action even if the cassette 1 is more or less completely filled with cards, the weight of the cards acting on the climbing wheels 13*a* and 13*b* via the depositing plate 9.

Provided between the respectively first gearwheel 41*a*/*b* and second gearwheel 43*a*/*b* of the respective set of gearwheels 39*a*, 39*b* in each case is a respective coaxial thickening 51*a*, 51*b*, on which the respective bearing bushing 27*a*, 27*b* then slides in each case in order to pivot the respective retaining unit 15*a*, 15*b*.

Figure 10:
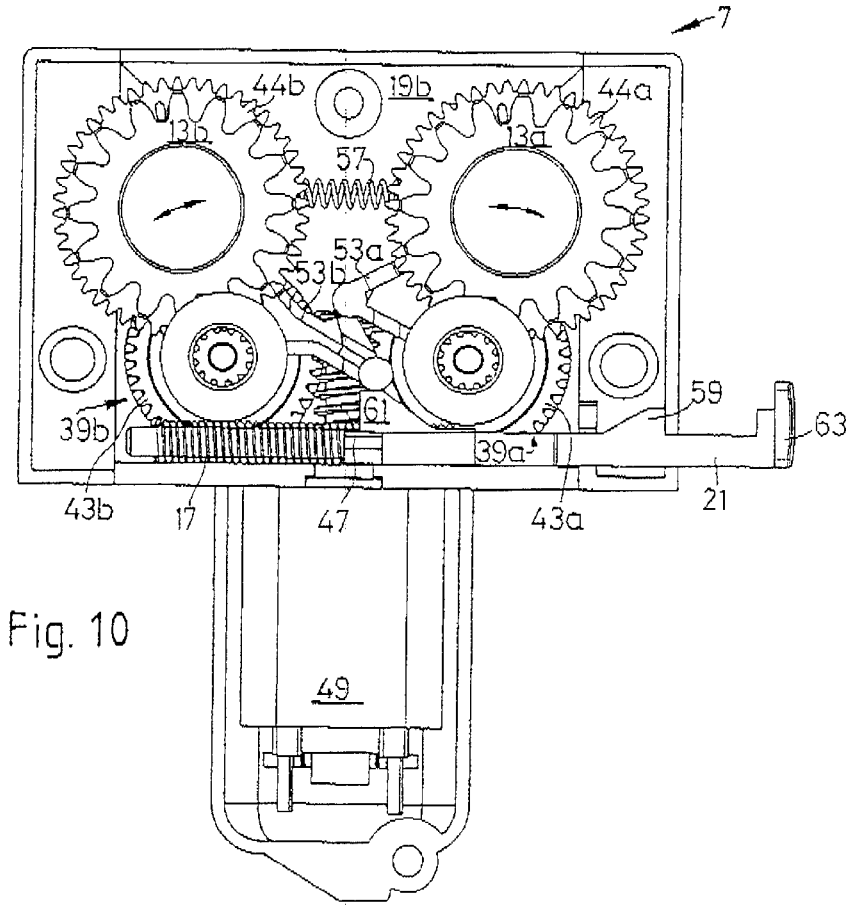
FIG. 10 shows an enlarged illustration of the lift unit in a position in which it has been rotated vertically through 180° in relation to the illustration in FIG. 1, it being the case here that a corresponding housing part has been removed in order to show the "internals"

The function of the climbing wheels 13*a* and 13*b* being moved toward one another is explained with reference to FIG. 10. FIG. 10 shows a view into the lift unit 7 which has been pivoted through 180° in a horizontal plane against the view in FIG. 1. In relation to FIG. 1, it shows the rear side of the lift unit, with the housing part 19*a* assumed.

One retaining unit 15*a* and the other retaining unit 15*b* have, as can also be seen in FIGS. 3 and 4, a respective first lever-like extension 53*a* and second lever-like extension 53*b*. The two extensions 53*a* and 53*b* are directed away from a respective geometrical connecting axis 54*a*, 54*b* between in each case the first respective geometrical bearing-bushing axis 56*a*, 56*b* and the relevant geometrical pivot-articulation axis 29*a*, 29*b*, respectively, of the relevant retaining unit 15*a*, 15*b*, respectively. An eyelet 55*a*, 55*b* is arranged on each of the first respective bearing bushings 23*a* and 23*b*. Suspended in said eyelets 55*a*, 55*b* is a tension spring 57, which can be seen in FIGS. 1 and 10 and subjects the two climbing wheels 13*a* and 13*b* to a tensile force in order to move them toward one another.

The slide 21 has a catch-like elevation 59 which, as is illustrated in FIG. 10, in the rest position of the slide, i.e. when the climbing wheels 13*a* and 13*b* engage in the teeth 12 of the racks 11*a* and 11*b*, is pressed against the inside of the side wall of the housing part 19*b* by the force of the compression spring 17. The slide 21 has a further elevation 61 with a slope 64 sloping down in the direction of the slide head 63. In the rest position of the slide, which is shown in FIG. 10, the end of the extension 53*a* rests on said elevation 61 and the end of the extension 53*b* rests on the extension 53*a*, with a bearing force produced by the tension spring 57. If the slide 21 is then pressed in manually, the end of the extension 53*a* slides downward on the slope 64 by way of the force of the tension spring 57, as a result of which the extension 53*b* is also moved downward. The two movements cause the retaining units 15*a* and 15*b* to pivot inward, as a result of which the climbing wheels 13*a* and 13*b* are also moved inward.

Figure 11:
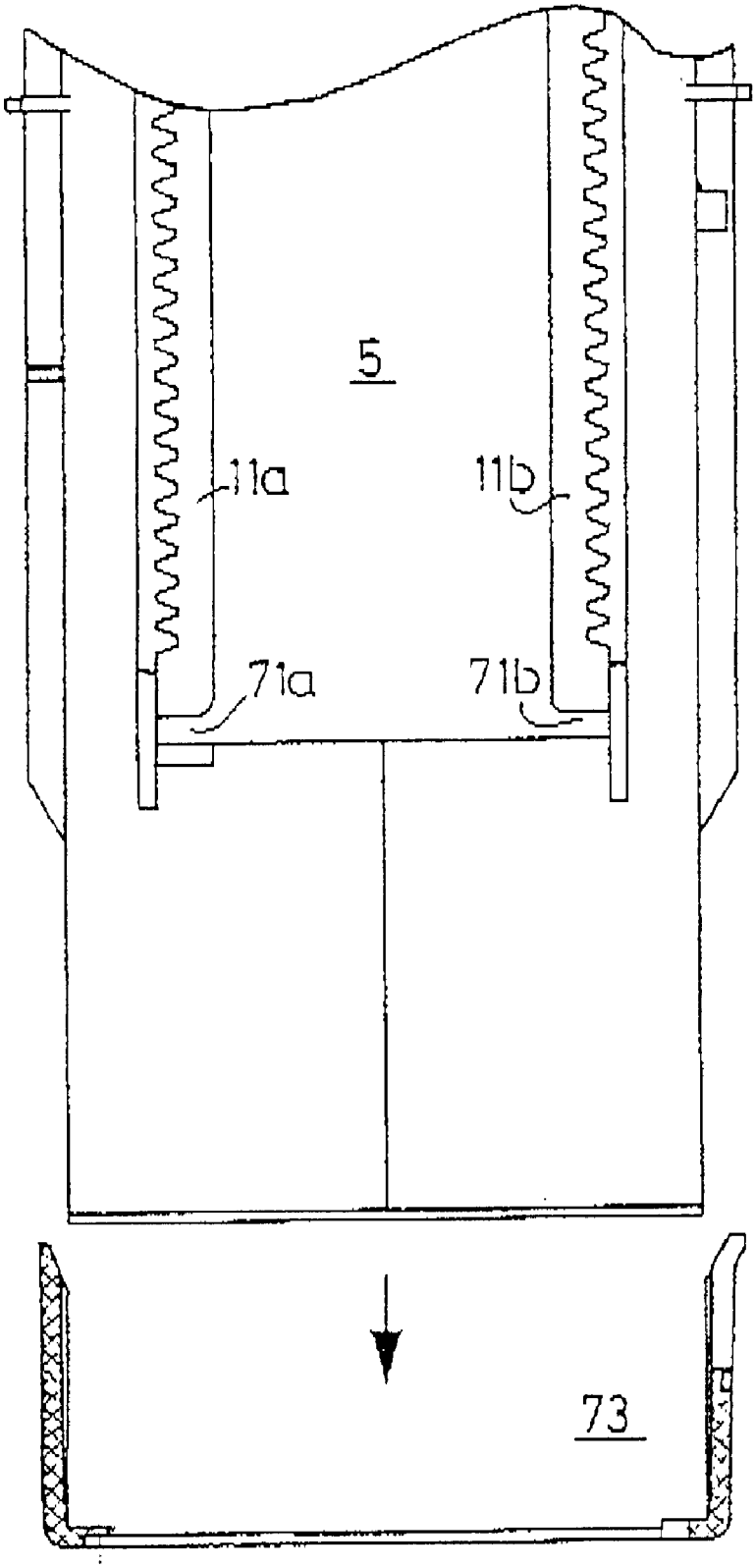
FIG. 11 shows a side view of the cassette removed from the foot of the cassette.

The lift unit 7 has a cutout 65*a*, 65*b* on both sides of the transition of the depositing plate 9 into the housing part 19*a*, said cutout being selected to be large enough for it to engage around the racks 11*a* and 11*b*. The cutout borders 67*a* and 67*b* thus slide along the inner border of the cassette opening 5. On its vertical outer side, the housing part 19*a* is of web-like design from top to bottom. This web 67*a*, 67*b* thus slides on the outside of the cassette 1 in the region 69*a*, 69*b*. As a result, the lift unit 7 is retained reliably in the opening 5. In order then for it to be possible for the lift unit 7 to be removed from a card-filled cassette 1, the latter, as shown in FIG. 11, has on both sides in its bottom region, at the rack ends, a slot 71*a*, 71*b*, of which the slot width is greater by a tolerance than the thickness of the depositing plate 9. If the climbing wheels 13*a* and 13*b*, as has been described above, are then moved toward one another in the lowermost position of the lift unit 7, the latter can be removed.

As has already been explained above, the stack-storage cassette 1 is only used for accommodating processed cards. If the cassette 1 is full, the intension is for the lift unit 7 to be removed and inserted into a new, empty cassette 1. In addition, the cassettes 1, then, are configured such that they can each be straightforwardly inserted into, and removed from, a plug-in securing means 73, which is indicated in FIG. 11, of a processing installation (not illustrated specifically) by means of a click-in retaining mechanism.

As has already been explained above, the lift unit 7 is lowered in a stepwise manner once it has been part-loaded. The loading state is determined by a light barrier 75, as is merely indicated by dashed lines in FIG. 1. The light barrier 75 and the electric motor 49 are connected to the unit 3 in respect of signaling and energy. In addition, the light barrier 75 is arranged directly on the unit. A horizontal light beam of the light barrier 75 runs, for example, through an opening in the top border region of the cassette 1. Depending on the back-scattered light flux, it is then possible to determine when filling has been achieved. The electric motor 49 and thus also the lift unit 7 are connected to the unit 3 via electric cable. The cable length is selected such that a filled cassette 1 can easily be exchanged for an empty one.

It would also be possible for the racks 11*a* and 11*b* to be arranged with the teeth 12 oriented away from the opening. In this case, the climbing wheels would then act on the outside and, in order for the lift unit to be removed, would have to be pressed away in the outward direction. This design would cause a lateral increase in size in relation to the one described above.

The cutouts 36*a* in the respective plug-on parts 30*a*, 30*b* and the matching cutouts 36*b* in the retaining units 15*a* and 15*b*, then, are designed such that the respective climbing wheel 13*a*, 13*b* and the respective gearwheel 44*a*, 44*b* engage through them. In order for the lift unit 7 to function, however, all that is necessary is for the respective gearwheel 44*a*, 44*b* to engage through. It is thus not absolutely necessary for the climbing wheel 13*a*, 13*b* to engage through, in which all that is then necessary is for its diameter to be selected to be large enough for it to be moved past the ring 32.

What is claimed is:

1. A storage apparatus having a card-accommodating, vertically upright stack-storage cassette having a unit for card input, card reading and controlling, said stack-storage cassette having a top cassette-border region, a cassette side, a store interior space and an upper and a lower cassette end region, said cassette side having a vertically running storage cassette opening said unit being adjacent to said top cassette-border region, and having a lift unit, said lift unit having a lift housing and a depositing plate for the cards which comes to rest in said store interior space, said lift unit having the lift housing and the depositing plate being removable and insertable in said cassette end region and being displaceable vertically, i.e. lowered by distance in height, in said opening, in order for the cards to be deposited satisfactorily.

2. Storage apparatus according to claim 1 wherein said lift unit being displaceable vertically in each case by the distance of a height over which a group of cards is deposited.

3. Storage apparatus according to claim 1 wherein said opening having opening borders, each opening border has a rack which runs longitudinally on it, said lift unit, on both sides, has in each case one climbing wheel, said climbing wheel meshes with the corresponding rack for displacing vertically said lift unit.

4. Storage apparatus according to claim 3 wherein the longitudinally running rack has teeth directed toward the opening, and climbing wheels on both sides of the lift unit are designed as a gearwheel meshing with the teeth.

5. Storage apparatus according to claim 3 wherein each climbing wheel is retained pivotably in a respective first and second retaining unit such that each climbing unit is pressable against one of the racks, and the two climbing wheels being displaceable toward one another in order to remove the lift unit from the cassette.

6. Storage apparatus according to claim 5 wherein each climbing wheel is retained pivotably in a respective first and second retaining unit such that each climbing wheel is pressable with spring loading against one of the racks.

7. Storage apparatus according to claim 5, wherein each retaining unit is designed as a lever, said lever having a first and a second lever end, each climbing wheel having a rotary axle, the first lever end having a horizontally running first bearing bushing, which accommodates in each lever the rotary axle for one of the climbing wheels, and the second lever end retaining pivotably by a pivot articulation.

8. Storage apparatus according to claim 3 wherein the lift unit has a set of gearwheels, said set of gearwheels having first and second gearwheels, the climbing wheels being driveable via in each case by one set of said gearwheels, of which in each climbing wheel the first gearwheel meshes with one of the climbing wheels and each second gearwheel of the set of gearwheels meshes with a worm wheel, in order that, on the one hand, the climbing wheels run in the same direction and, on the other hand, self-locking of the climbing wheels is achieved when the lift unit is at a standstill.

9. Storage apparatus according to claim 8, wherein the climbing wheels being driveable via in each case by one set of said gearwheels, of which in each climbing wheel the first gearwheel meshes with a gearwheel connected and firmly assigned to one of the climbing wheels and the worm wheel being driveable by an electric motor.

10. Storage apparatus according to claim 5, wherein each retaining unit is designed as a lever, said lever having a first and a second lever end, each climbing wheel having a rotary axle, the first lever end having a horizontally running first bearing bushing which accommodates in each lever the rotary axle for one of the climbing wheels, and the second lever end retaining pivotably by a pivot articulation, said pivot articulation has a second bearing bushing, the lift unit has a set of gearwheels, said set of gearwheels having first and second gearwheels, the climbing wheels being driveable via in each case by one set of said gearwheels, of which in each climbing wheel the first gearwheel meshes with one of the climbing wheels and each second gearwheel of the sets of gearwheels meshes with a worm wheel, in order that, on the one hand, the climbing wheels run in the same direction and, on the other hand, self-locking of the climbing wheels is achieved when the lift unit is at a standstill, said set of gearwheels having a coaxial thickening arranged between the first and second gearwheels, said second bearing bushing slides on said coaxial thickening.

11. Storage apparatus according to claim 10, wherein in each climbing wheel one journal, which is arranged on the inside of the lift housing and is provided with a bore, and a third bearing bushing at the other lever end, said bearing bushing adjoining the second bearing bushing, the third bearing bushing and the journal being designed such that each retaining unit can be pivoted or, the relevant journal by way of the third bearing bushing.

12. Storage apparatus according to claim 11, wherein each second bearing bushing and the third bearing bushing have a cutout through which the climbing wheel engages with meshing action in the first gearwheel.

13. Storage apparatus according to claim 11, wherein each second bearing bushing and the third bearing bushing have a cutout through which the firmly assigned gearwheel of the climbing wheel engages with meshing action in the first gearwheel.

14. Storage apparatus according to claim 3 wherein each climbing wheel is retained pivotably in a respective first and second retaining unit such that each climbing wheel is pressable against one of the racks, and the two climbing wheels being displaceable toward one another in order to remove the lift unit from the cassette, each retaining unit is designed as a lever, said lever having a first and a second lever end, each climbing wheel having a rotary axle, the first lever end having a horizontally running first bearing bushing, which accommodates in each lever the rotary axle for one of the climbing wheels, and the second lever end retaining pivotably by a pivot articulation, a first lever-like extension on the first retaining unit, a second lever-like extension on the second retaining unit, a tension spring between the first bearing bushings of the first and second retaining units and a slide which can be actuated manually counter to the force of a compression spring, the two extensions are arranged such that they are directed away from a geometrical connecting axis between in each case the first geometrical bearing-bushing axis and the relevant geometrical pivot-articulation axis, and rest one upon the other as a result of the force of the tension spring, the slide has an elevation which, in a rest state of the slide, in which the latter has not been pushed in against the lift housing, holds up the second extension, and the first extension, and, in the pressed-in state, by virtue of the elevation being pushed away, allows the two extensions to move downward, as a result of which the two retaining units move the climbing wheels toward one another, as a result of which the lift unit is removable from the opening.

15. Storage apparatus according to claim 14, wherein said opening having at the bottom opening border a slot corresponding to the deposition plate for removing the lift unit from the opening.

16. Storage apparatus according to claim 1, wherein a filling level-monitoring unit, in the top cassette region, which establishes a card-filling level on the depositing plate and then via the card-input, -reading and control unit, lowers the lift unit by a predetermined distance.

* * * * *